US008176906B2

(12) United States Patent
Simo et al.

(10) Patent No.: US 8,176,906 B2
(45) Date of Patent: May 15, 2012

(54) CABLE BUSS APPARATUS FOR DEFLECTING TENSION CABLES IN A COMPOUND BOW

(75) Inventors: Miroslav A. Simo, Riverside, IL (US); Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 140 days.

(21) Appl. No.: 12/553,378

(22) Filed: Sep. 3, 2009

(65) Prior Publication Data

US 2011/0048394 A1 Mar. 3, 2011

(51) Int. Cl.
*F41B 5/10* (2006.01)

(52) U.S. Cl. ..... 124/25.6

(58) Field of Classification Search ..... 124/25.6
See application file for complete search history.

(56) References Cited

U.S. PATENT DOCUMENTS

| | | | | |
|---|---|---|---|---|
| 4,452,222 | A | 6/1984 | Quartino et al. | |
| 4,733,648 | A * | 3/1988 | Martin | 124/86 |
| 4,903,678 | A | 2/1990 | Walker | |
| 6,382,201 | B1 | 5/2002 | McPherson et al. | |
| 6,681,754 | B1 | 1/2004 | Angeloni | |
| 6,708,684 | B2 | 3/2004 | Chattin | |
| 6,722,354 | B1 | 4/2004 | Land | |
| 6,729,320 | B1 * | 5/2004 | Terry | 124/25.6 |
| 6,758,204 | B1 | 7/2004 | Goff et al. | |
| 6,763,818 | B2 * | 7/2004 | Larson | 124/25.6 |
| 6,792,930 | B1 | 9/2004 | Kronengold et al. | |
| 6,904,900 | B2 | 6/2005 | Gallops, Jr. | |
| 6,966,312 | B1 | 11/2005 | Larson | |
| 7,047,958 | B1 | 5/2006 | Colley | |
| 7,082,937 | B1 | 8/2006 | Land | |
| 7,308,890 | B1 | 12/2007 | Wheeler | |
| 7,441,555 | B1 | 10/2008 | Larson | |
| 2006/0174859 | A1 | 8/2006 | Andrews | |
| 2007/0101980 | A1 * | 5/2007 | Sims et al. | 124/25.6 |
| 2009/0000606 | A1 | 1/2009 | Cooper et al. | |
| 2009/0165766 | A1 * | 7/2009 | Evans | 124/25.6 |

OTHER PUBLICATIONS http://www.bowrun.com/images/2008/hoyt-katera.jpg (1 page), at least as early as Mar. 29, 2008.
http://www.bowhunting.net/artman/publish/KeithDunlap/Field_Evaluation_-_Bear_Truth_2_printer, "Field Evaluation—Bear Archery Truth 2," Aug. 19, 2008 (6 pages).
http://www.skinnymoose.com/stabley/wp-content/uploads/2008/01/dxt_dia-1.jpg (1 page), at least as early as Jan. 29, 2008.

(Continued)

*Primary Examiner* — John Ricci
(74) *Attorney, Agent, or Firm* — Pauley Petersen & Erickson

(57) ABSTRACT

A cable buss apparatus for an archery bow for laterally deflecting tension cables extending between two opposing cams of the bow to prevent interference with an arrow. The apparatus includes a first cable alignment rod that is attachable to an upper portion of the bow for deflecting a first section of the cables extending between an upper cam and a cable guard. A second cable alignment rod is attachable to a lower portion of the bow for deflecting a second section of the cables extending between a lower cam and the cable guard. The cable guard can be a conventional cable guard, or the cable guard can include one or more further cable alignment rods similar or different from the first and second cable alignment rods.

20 Claims, 4 Drawing Sheets

OTHER PUBLICATIONS http://www.bowrun.com/images/2008/bowtech-general.jpg (1 page), as least as early as Mar. 29, 2008.

http://www.archeryhistory.com/compounds/70.php, "Bows 1970-1979," The illustrated bows were know sufficiently earlier than the effective U.S. fileing date, so that the particular month of publication for each bow is not an issue.

http://www.archeryhistory.com/compounds/80.php, "Bows 1980-1989," The illustrated bows were known sufficiently earlier than the effective U.S. filing date, so that the particular month of publication for each bow is not an issue.

* cited by examiner

CABLE BUSS APPARATUS FOR DEFLECTING TENSION CABLES IN A COMPOUND BOW

BACKGROUND OF THE INVENTION

1. Field of the Invention

This invention relates generally to cable guards for archery bows and, more particularly, to a cable buss system for using with or as a cable guard for a compound archery bow.

2. Discussion of Related Art

Compound archery bows include a bowstring that includes, forms, or is otherwise connected to tension cables that are connected between opposing cams on upper and lower bow limbs. The bowstring and cables are desirably positioned at or proximate to the vertical centerline of the bow. When the cables and bowstring are aligned in or near the same vertical plane, an arrow released from the bowstring may contact the cables, thereby interfering with the flight of the arrow.

Cable guards are commonly used to prevent this interference by displacing or deflecting the cables a sufficient distance from the bowstring. Exemplary illustrations of cable guards are illustrated in FIGS. 1 and 2. The cable guard 20 is commonly connected at one end to the bow 22, and includes a rod-like element 24 that extends toward the cables 25 but at a laterally offset distance from the plane of the bowstring 26. To provide the offset positioning, the cable guard 20 can, for example, include a bend as shown in FIG. 1, or be attached to an outer side surface of the bow as shown in FIG. 2. A cable slide 28 can be used to connect the cables to the cable guard.

Cable guards exert a torque on the bow when the bowstring is drawn. The lateral deflection of the cables causes a twisting at the cams, resulting in left or right forces. These forces caused by the tension cables deflected against the cable guard, particularly when the bowstring is at full draw, can have a negative affect on the bow during use. There is a continuing need for a cable guard system that removes cables from an arrow flight path while minimizing torque forces on the bow.

SUMMARY OF THE INVENTION

This invention includes and provides a cable buss apparatus for an archery bow using a cable guard for laterally deflecting tension cables of a bowstring that extend between two opposing cams, in order to prevent interfering with an arrow. The apparatus includes a first cable alignment rod that is attachable to an upper portion of the bow for deflecting a first section of the cables extending between an upper cam and the cable guard. The apparatus also includes a second cable alignment rod attachable to a lower portion of the bow for deflecting a second section of the cables extending between a lower cam and the cable guard.

The apparatus of this invention allows for laterally displacing tension cables away from a flight path of a launching arrow without imparting lateral and/or twisting forces on the upper and lower cams. The apparatus of this invention moves the lateral stress caused by the deflected tension cables away from the upper and lower cams of the bow, thereby reducing forces on the cams, which can reduce cam and cable wear while also providing a steadier draw and launch for the archer.

The invention further includes an archery bow with a riser, an upper limb connected to a first end of the riser and including an upper cam at an end opposite the riser, and a lower limb connected to a second end of the riser and including a lower cam at an end opposite the riser. A bowstring and tension cables extend between the upper cam and the lower cam. A cable guard deflects the cables between the upper cam and the lower cam. A first cable alignment rod attached to the bow engages the cables between the cable guard and the upper cam, and a second cable alignment rod attached to the bow engages the cables between the cable guard and the lower cam.

Other objects and advantages will be apparent to those skilled in the art from the following detailed description taken in conjunction with the appended claims and drawings.

BRIEF DESCRIPTION OF THE DRAWINGS

FIGS. 2-7 each illustrate an exemplary cable alignment rod according to embodiments of this invention.

DETAILED DESCRIPTION OF THE INVENTION

The present invention provides a cable buss apparatus for an archery bow for use as or with a cable guard for laterally deflecting cables extending between two opposing cams of a bow to prevent cable interference with an arrow during launch. The cable buss apparatus of this invention can be an accessory to be added on to existing bows, or can be integrated into bows during manufacture and/or sale.

In one embodiment of this invention, the cable buss apparatus includes a first cable alignment rod attachable to an upper portion of the bow for deflecting a first section of the cables extending between an upper cam and a cable guard, and a second cable alignment element attachable to a lower portion of the bow for deflecting a second section of the cables extending between a lower cam and the cable guard. The cable alignment rods of this invention can be any structure that serves as a mechanism to move the point of lateral cable deflection above or below, respectively, the opposing bow cams. As will be discussed further below, the two cable alignment rods can be used in combination with existing cable guards, or can be used with one two additional cable alignment rods of this invention as cable guards.

FIGS. 3-7 illustrate, without limitation, exemplary embodiments of cable alignment rods according to presently preferred embodiments of this invention. A common feature of these embodiments is a cable contact surface which contacts and engages the cables. The cable contact surface can be a stationary or moving surface to facilitate the movement of the cables during bowstring draw and release. The cable contact surface can be embodied as or include one or more groove structures or equivalent, for maintaining the position of the cables. The cable contact surface also is preferably at least partially rounded and/or angled to allow the cable to deflect or bend around the cable contact surface toward the cable guard or a next cable alignment rod.

Figure 1:
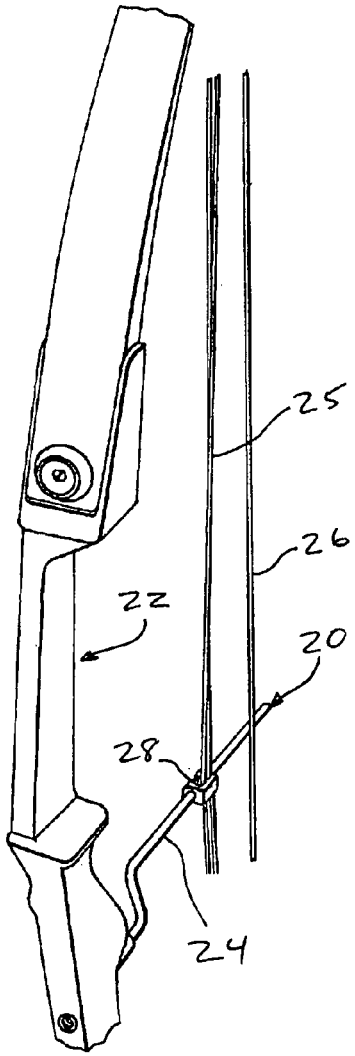
FIG. 1 Prior Art
FIGS. 1 and 2 illustrate examples of conventional cable guards.
Figure 2:
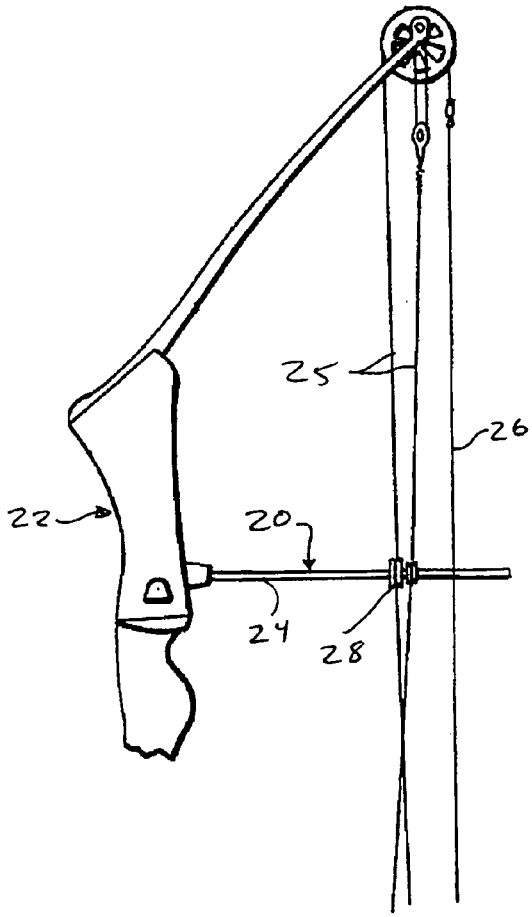
FIG. 2 Prior Art
Figure 3:
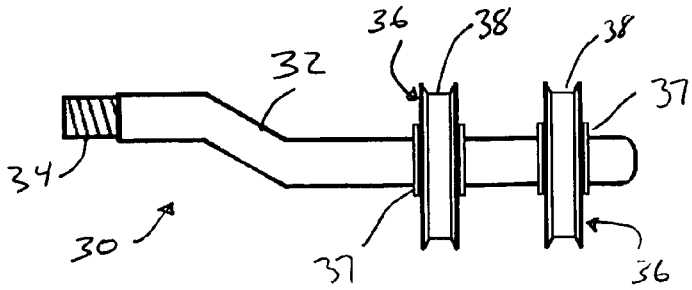
Figure 4:
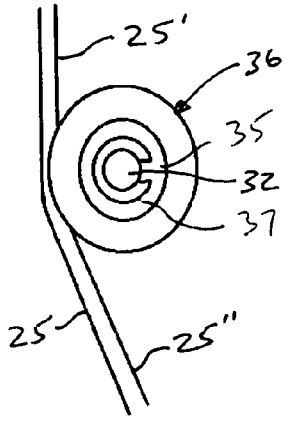

FIGS. 3 and 4 illustrate a cable alignment rod 30 according to one embodiment of this invention. Cable alignment rod 30 includes a shaft 32 having an attachment mechanism at one end for attaching to a bow. In FIG. 3, the attachment mechanism is shown as a threaded end 34 for attachment into a corresponding threaded receiver on the bow. Other attachment mechanisms are also available, such as an opening for receiving a bolt therethrough. The cable alignment rod 30 includes two rollers 36, one for each of two cables, as the cable contact surface. As will be appreciated by those skilled in the art reading this disclosure, any suitable roller or roller size, shape, or configuration can be used. In the illustrated embodiment, the rollers 36 include an outer circumferential cable engagement groove 38 that rotates around a bearing 35. Each of the rollers 36 is secured to the shaft 32 by a pair of c-clamps 37.

The cable alignment rod can have any suitable shape, depending on, for example, the configuration of the bow it will be attached to. In the embodiment shown in FIGS. 3 and 4, the shaft 32 is sufficiently offset (i.e., bent) in order to align the surface of one side of grooves 38 with the cables 25 leaving the cams (not shown). As shown in FIG. 4, the rollers 36 are used to maintain a first portion 25' of the cables 25 leaving the cam generally or substantially parallel with a vertical centerline of the bow. The cables 25 deflect or bend around the roller 36 and a second portion 25" of each cable is deflected toward a cable guard or, depending on the configuration a second cable alignment rod or equivalent element.

Figure 5:
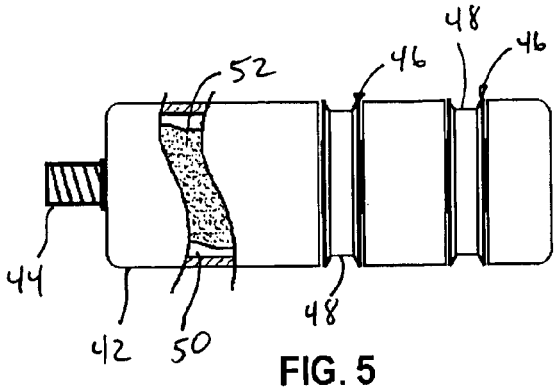

FIG. 5 illustrates a cable alignment rod 40 according to another embodiment of this invention. Cable alignment rod 40 includes a hollow body 42 having an attachment mechanism, shown as a threaded end 44, at one end for attaching to a bow. The cable alignment rod 40 includes two rollers 46 with an outer circumferential cable engagement groove 48. In the embodiment of FIG. 5, the cable alignment rod 40 has a dual purpose of engaging the bow cable, and also serving as a stabilizer. The hollow body 42 forms a chamber 50 including a stabilizer material 52. Stabilizer materials and other suitable stabilizer configurations known to those skilled in the art can be incorporated into a cable alignment rod of this invention. One such stabilizer configuration is disclosed in commonly assigned U.S. Pat. No. 6,494,196, herein incorporated by reference.

Figure 6:
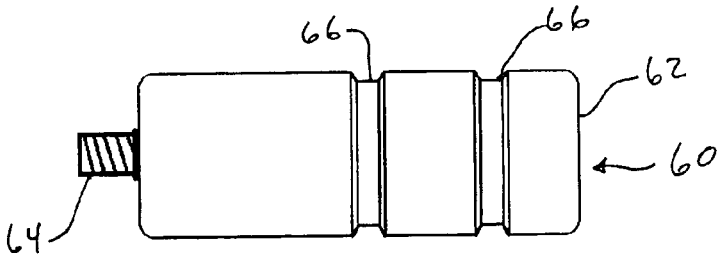

FIG. 6 is a cable alignment rod 60 according to another embodiment of this invention. Cable alignment rod 60 is similar in overall shape and configuration to cable alignment rod 40, but does not include any roller. Cable alignment rod 60 includes a body 62 and a threaded end 64 for attaching to a bow. Cable alignment rod 60 includes two cable engagement grooves 66 as the cable contact surface. The grooves 66 are formed in the outer surface of the body 62, and can be a polished material of the body 62, such as metal or plastic, and/or optionally lubricated to reduce friction and resistance of the moving cables across the grooves 66.

Figure 7:
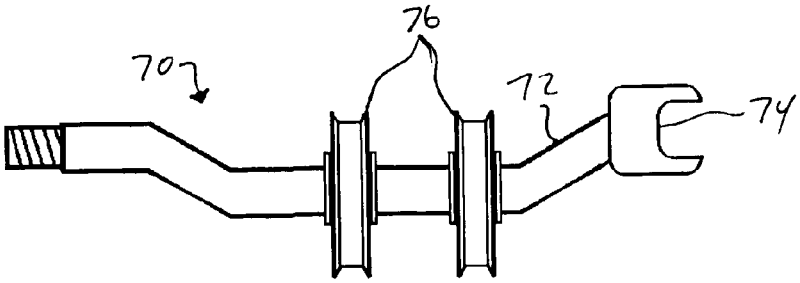

FIG. 7 illustrates another embodiment of a dual purpose cable alignment rod. In FIG. 7, cable alignment rod 70 is embodied similar to the cable alignment rod 30 shown in FIG. 3, and further includes a string stop receiver 74 at an end of a shaft 72. The shaft 72 is bent or curved twice so that the rollers 76 align with cables of the bow, and the receiver 74 is aligned to receive a released bowstring. The function and various materials and configurations for the string stop receiver 74 are known to those skilled in the art of archery bows.

Figure 8:
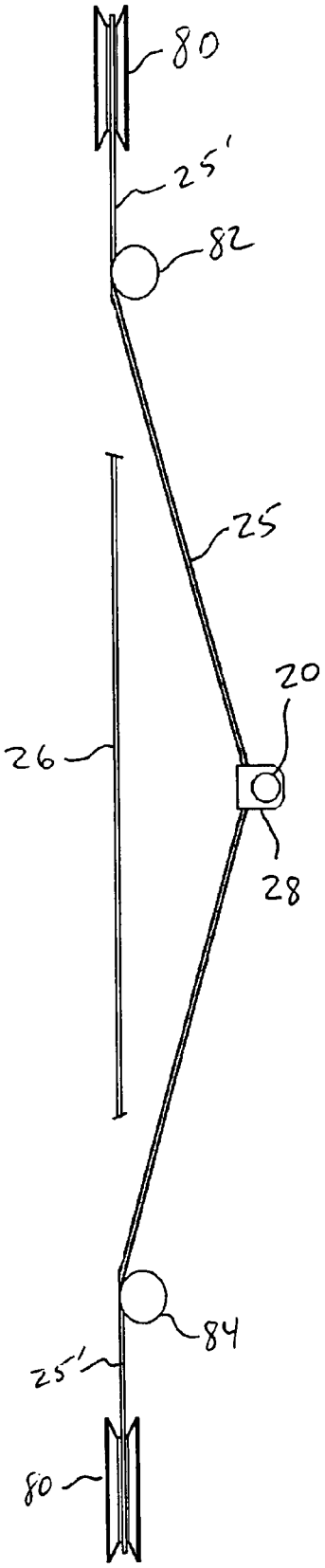
FIGS. 8-10 illustrate cable alignment rod configurations, and resulting cable configurations, according to embodiments of this invention.
Figure 9:
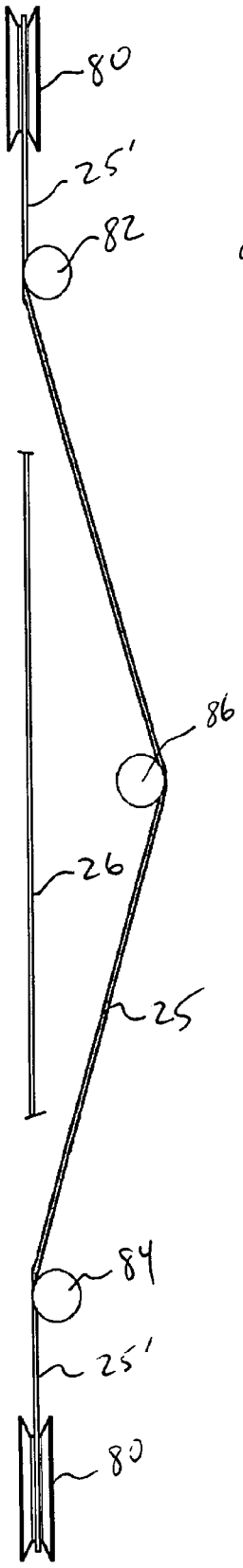

In one embodiment of this invention, two or more cable alignment rods function as a starting point to laterally deflect cables of a compound bow toward one side of the vertical centerline of a bow so that the cables do not interfere with the launch of an arrow from the bow. FIGS. 8-9 representatively illustrate three alternative configurations of the use of the cable buss system of this invention with a bow. In FIGS. 8-9, for ease of explanation, the bow is generally represented by opposing cams 80. A bowstring 26 and cables 25 extend between the cams 80. Cable alignment rods are representatively illustrated, and can be any cable alignment rod of this invention, such as disclosed above.

In FIG. 8, two cable alignment rods 82 and 84 are used in combination with a conventional cable guard 20. A first cable alignment rod 82 is attached to the bow, either to a riser or limb of the bow, a distance below an upper cam 80. Similarly, a second cable alignment rod 84 is attached to the bow a distance above a lower cam 80. In FIG. 8, the cable guard 20 and cable slide 28 secure the cables 25 in a laterally deflected position away from the bowstring 26. The cable alignment rods 82 and 84 move the point the cables 25 deflect or bend toward the cable guard 20 below and above, respectively, the cams 80. Each of the first cable alignment rod 82 and the second cable alignment rod 84 maintains a portion 25' of the cables 25 in a position at least substantially parallel with the non-deflected position, such as substantially along the vertical centerline between the cams 80. In the configuration of FIG. 8, the cable buss apparatus of this invention removes torque and/or other twisting or side forces placed upon the cams through use of a cable guard alone. This in turn removes eccentric loads from the limbs of the bow.

In FIG. 9, the cable guard comprises a third cable alignment rod 86 that is according to this invention, for example, as described above. The third cable alignment rod 86 functions as a cable guard and can be the same or different than the first and second cable alignment rods 82 and 84. To allow for movement of the cables 25 in the forward and rear directions during drawing and releasing of the bowstring 26, a portion of the cable alignment can accommodate such movement. For example, a roller of the cable alignment rod 86 can be free to move along the shaft much like a cable slide on a cable guard, or the groove in the cable alignment rod can be made wider to allow movement within the groove. An optional cable locking element can extend over rollers to further keep the cables within the rollers.

Figure 10:
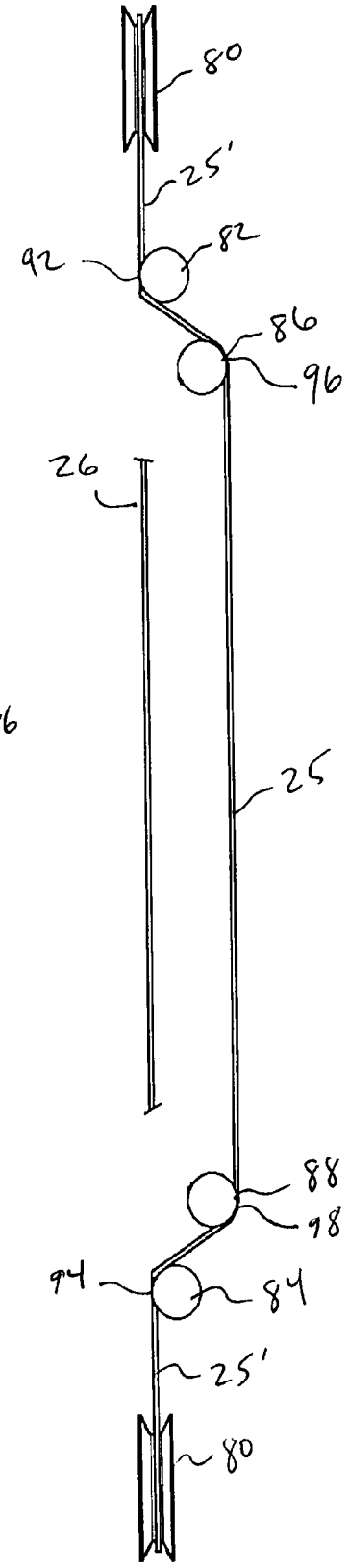

In one embodiment of this invention, the first and second cable alignment rods 82 and 84 are each used in combination with a cable guard or a further cable alignment rod. FIG. 10 illustrates an exemplary embodiment. The configuration illustrated in FIG. 10 includes as a cable guard a third cable alignment rod 86 positioned between a central nock area of the bowstring 26 and the first cable alignment rod 82, and desirably in close proximity to the first cable alignment rod 82. A fourth cable alignment rod 88 is similarly positioned as a second cable guard between the nock area of the bowstring 26 and the second cable alignment rod 84, and desirably in close proximity to the second cable alignment rod 84. The third and fourth cable alignment rods 86 and 88 can be any cable alignment rod of this invention, such as disclosed above, or can be cable guards such as are known for use with current compound bows.

The first cable alignment rod 82 and the second cable alignment rod 84 each have a side 92 and 94, respectively, facing a first lateral direction and aligned between the upper and lower cams to receive the cables 25 while maintaining the vertical position of cable portions 25'. Each of the third cable alignment rod 86 and the fourth cable alignment rod 88 has a side 96 and 98, respectively, facing a second lateral direction that is opposite the first lateral direction. The cables 25 contact the sides 92 and 94 of the first and second cable alignment rods 82 and 84 and are deflected laterally to wrap around the second sides 96 and 98 of the third and fourth cable alignment rods 86 and 88. A laterally positioned portion of the cables 25 extends between the third and fourth cable alignment rods 86 and 88, thereby moving the cables away from possible interference with an arrow during launch.

Various sizes, shapes, placements, and configurations are available for the cable alignment rods of this invention. For example, in FIG. 10, the third and fourth cable alignment rods or cable guards 86 and 88 are laterally offset from the first and second cable alignment rods 82 and 84. As an alternative, shown in FIG. 12, the four cable alignment rods can be vertically aligned.

Figure 11:
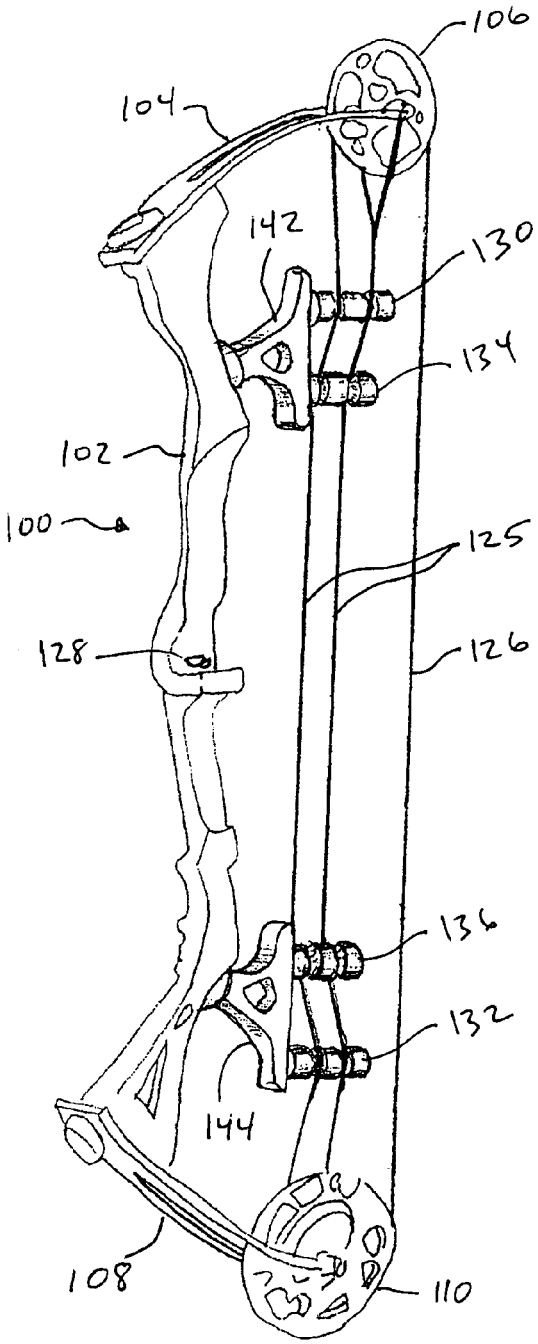
FIGS. 11 and 12 illustrate a bow including a cable buss apparatus according to one embodiment of this invention.

FIG. 11 shows, without limitation, a representative archery bow 100 including the cable buss apparatus of this invention. The archery bow includes a riser 102, a upper limb 104 connected to a first end of the riser and including an upper cam 106 at an end opposite the riser, and a lower limb 108 connected to a second end of the riser and including a lower cam 110 at an end opposite the riser. A bowstring 126 extends between and around the cams extending or leading into two tension cables 125.

The cable buss apparatus includes a first cable alignment rod 130 attached to the bow 100 and engaging the cables 125 beneath the upper cam 106. On an opposite end, the cable buss apparatus includes a second cable alignment rod 132 attached to the bow 100 and engaging the cables 125 above the lower cam 110. The cable buss apparatus also includes two additional cable alignment rods 134 and 136 acting as cable guards to secure the cables 125 in a lateral direction in an area of arrow rest 128 and away an arrow launched with the bow 100.

Figure 12:
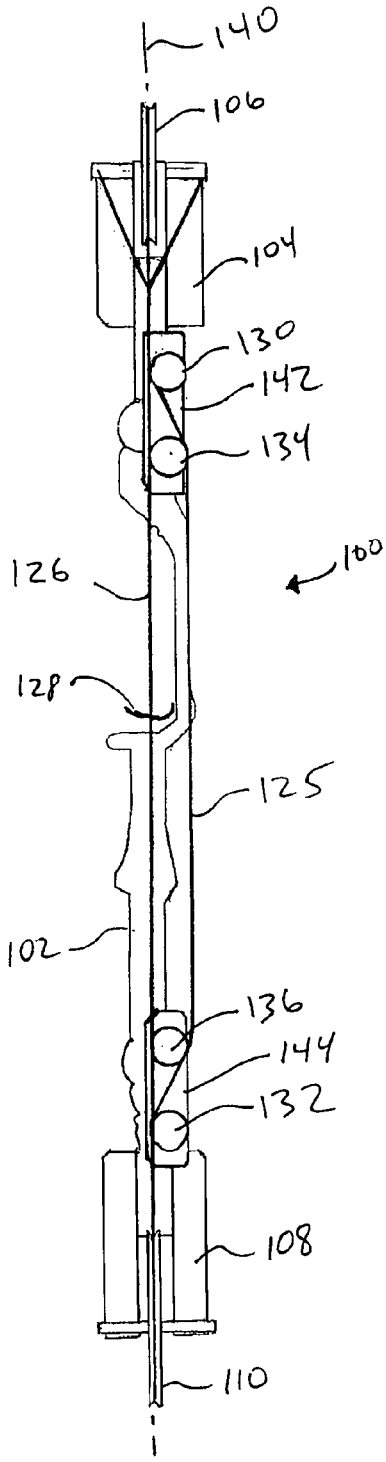

As shown in FIGS. 11 and 12, the first cable alignment rod 130 and the third cable alignment rod 134 are aligned beneath the upper cam 106 with a first side, and more particularly the groove of the cable contact surface, aligned and adjacent to the vertical plane 140 of the cables 125 between the cams 106 and 110. From the upper cam 106, the cables 125 extend along the vertical plane 140 until the cables bend 125 around the cable contact surface of the first cable alignment rod 130. The cables 125 then laterally extend toward and around a portion of the third cable alignment rod 134. The cables 125 extend laterally offset from and parallel to the vertical plane 140 between the third and fourth cable alignment rods 134 and 136. The cables 125 bend around the fourth cable alignment rod 136 and then the second cable alignment rod 132 to be positioned back in line with the vertical plane 140 between the second cable alignment rod 132 and the lower cam 110.

The first cable alignment rod 130 and the third cable alignment rod 134 can each be mounted directly to the riser 102, or through an intermediate first mounting element 142. The first mounting element 142 includes two receivers for the first and third cable alignment rods 130 and 134, and a single attachment element, such as a threaded end, for mounting to a bow. The first mounting element 142 can be particularly useful in retrofitting the two cable alignment rods 130 and 134 to a bow having a single receiver. Conventional bows often already include such a receiver in the riser for use with, for example, conventional string stops. A second mounting element 144 is used to attach the second and fourth cable alignment rods 132 and 136 to a lower portion of the riser 102. Various and alternative sizes, shapes, placements, and configurations are available for the alignment rods and mounting elements according to this invention. For example, instead of being mounted to the riser, the cable alignment rods and/or mounting elements can be mounted to the upper and lower limbs. Also, the cable alignment rods on the mounting elements can be offset as shown in FIG. 10, depending on need.

Thus, the invention provides a cable buss apparatus for a compound bow that laterally displaces tension cables away from a flight path of a launching arrow while not imparting lateral and/or twisting forces on the upper and lower cams. By moving the lateral stress caused by the deflected tension cables away from the cams, the apparatus of this invention can reduce forces on the bow during use and provide a steadier draw and launch for the archer.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A cable buss apparatus for an archery bow with a cable guard for laterally deflecting cables extending between two opposing cams of the bow to prevent cable interference with an arrow, the apparatus comprising:

a first cable alignment rod attachable to an upper portion of the bow for deflecting a first section of the cables extending between an upper cam and the cable guard; and a second cable alignment rod attachable to a lower portion of the bow for deflecting a second section of the cables extending between a lower cam and the cable guard;

wherein each of the first cable alignment rod and the second cable alignment rod is attachable to a riser of the bow.

2. The apparatus of claim 1, wherein each of the first cable alignment rod and the second cable alignment rod maintains a portion of the cables at least substantially parallel with the two opposing cams and the cables are deflected between the cable guard and each of the first cable alignment rod and the second cable alignment rod.

3. The apparatus of claim 1, wherein each of the first cable alignment rod and the second cable alignment rod comprises a cable contact surface.

4. The apparatus of claim 3, wherein the cable contact surface comprises a cable engagement groove.

5. A cable buss apparatus for an archery bow with a cable guard for laterally deflecting cables extending between two opposing cams of the bow to prevent cable interference with an arrow, the apparatus comprising:

a first cable alignment rod attachable to an upper portion of the bow for deflecting a first section of the cables extending between an upper cam and the cable guard;

a second cable alignment rod attachable to a lower portion of the bow for deflecting a second section of the cables extending between a lower cam and the cable guard; and a cable contact surface comprising a roller.

6. The apparatus of claim 5, wherein each of the first cable alignment rod and the second cable alignment rod is attachable to a riser of the bow.

7. A cable buss apparatus for an archery bow with a cable guard for laterally deflecting cables extending between two opposing cams of the bow to prevent cable interference with an arrow, the apparatus comprising:

a first cable alignment rod attachable to an upper portion of the bow for deflecting a first section of the cables extending between an upper cam and the cable guard;

a second cable alignment rod attachable to a lower portion of the bow for deflecting a second section of the cables extending between a lower cam and the cable guard; and wherein at least one of the first cable alignment rod or the second cable alignment rod comprises a hollow body forming a chamber and a stabilizer material within the chamber.

8. A cable buss apparatus for an archery bow with a cable guard for laterally deflecting cables extending between two opposing cams of the bow to prevent cable interference with an arrow, the apparatus comprising:

a first cable alignment rod attachable to an upper portion of the bow for deflecting a first section of the cables extending between an upper cam and the cable guard;

a second cable alignment rod attachable to a lower portion of the bow for deflecting a second section of the cables extending between a lower cam and the cable guard;

a first cable guard in combination with the first cable alignment rod and a second cable guard in combination with the second cable alignment rod.

9. The apparatus of claim 8, wherein the first cable guard comprises a third cable alignment rod, the second cable guard comprises a fourth cable alignment rod, the first cable alignment rod and the second cable alignment rod each have a first side facing a first lateral direction and aligned between the upper cam and the lower cam, and each of the third cable alignment rod and the fourth cable alignment rod has a second side facing a second lateral direction that is opposite the first lateral direction and laterally offset from the first side of each of the first cable alignment rod and the second cable alignment rod, wherein the cables contact the first side of each of the first cable alignment rod and the second cable alignment rod and are deflected laterally and around the second side of each of the third cable alignment rod and the fourth cable alignment rod.

10. The apparatus of claim 8, further comprising a first mounting element and a second mounting element, wherein the first cable guard and the first cable alignment rod are each mounted to the first mounting element and the second cable guard and the second cable alignment rod are each mounted to the second mounting element.

11. An archery bow, comprising:

a riser;

an upper limb connected to a first end of the riser and including an upper cam at an end opposite the riser;

a lower limb connected to a second end of the riser and including a lower cam at an end opposite the riser;

a bowstring and tension cables extending between the upper cam and the lower cam;

a cable guard deflecting the cables between the upper cam and the lower cam;

a first cable alignment rod attached to the bow and engaging the cables between the cable guard and the upper cam; and a second cable alignment rod attached to the bow and engaging the cables between the cable guard and the lower cam;

wherein each of the first cable alignment rod and the second cable alignment rod is attached to the riser of the bow.

12. The bow of claim 11, wherein the first cable alignment rod deflects a first section of the cables extending between an upper cam and the cable guard, and the second cable alignment rod deflects a second section of the cables extending between a lower cam and the cable guard.

13. The bow of claim 11, wherein each of the first cable alignment rod and the second cable alignment rod maintains a portion of the cables at least substantially parallel with the two opposing cams and the cables are deflected between the cable guard and each of the first cable alignment rod and the second cable alignment rod.

14. The bow of claim 11, wherein each of the first cable alignment rod and the second cable alignment rod comprises a cable contact surface.

15. The bow of claim 11, further comprising a second cable guard, wherein the cable guard is attached to the bow to engage the cables between the first cable alignment rod and the second cable guard and the second cable guard is attached to the bow to engage the cables between the second cable alignment rod and the cable guard.

16. The bow of claim 15, wherein the first cable guard comprises a third cable alignment rod and the second cable guard comprises a fourth cable alignment rod.

17. The bow of claim 16, wherein a first side of each of the first cable alignment rod and the second cable alignment rod is aligned between the upper cam and the lower cam, and a second side of each of the third cable alignment rod and the fourth cable alignment rod is offset from the first side of each of the first cable alignment rod and the second cable alignment rod, wherein the cables extend around the first side of each of the first cable alignment rod and the second cable alignment rod and the second side of each of the third cable alignment rod and the fourth cable alignment rod to deflect the cables laterally from the bow.

18. An archery bow, comprising:

a riser;

an upper limb connected to a first end of the riser and including an upper cam at an end opposite the riser;

a lower limb connected to a second end of the riser and including a lower cam at an end opposite the riser;

a bowstring and tension cables extending between the upper cam and the lower cam;

a cable guard deflecting the cables between the upper cam and the lower cam;

a first cable alignment rod attached to the bow and engaging the cables between the cable guard and the upper cam; and a second cable alignment rod attached to the bow and engaging the cables between the cable guard and the lower cam;

wherein each of the first cable alignment rod and the second cable alignment rod comprises a roller comprising a groove, and a portion of one of the cables is disposed within the groove and bends in a lateral direction around a portion of the roller.

19. The bow of claim 18, wherein each of the first cable alignment rod and the second cable alignment rod is attached to the riser of the bow.

20. An archery bow, comprising:

a riser;

an upper limb connected to a first end of the riser and including an upper cam at an end opposite the riser;

a lower limb connected to a second end of the riser and including a lower cam at an end opposite the riser;

a bowstring and tension cables extending between the upper cam and the lower cam;

a cable guard deflecting the cables between the upper cam and the lower cam;

a first cable alignment rod attached to the bow and engaging the cables between the cable guard and the upper cam;

a second cable alignment rod attached to the bow and engaging the cables between the cable guard and the lower cam;

a second cable guard, wherein the cable guard is attached to the bow to engage the cables between the first cable alignment rod and the second cable guard and the second cable guard is attached to the bow to engage the cables between the second cable alignment rod and the cable guard;

the first cable guard comprising a third cable alignment rod and the second cable guard comprising a fourth cable alignment rod; and a first mounting element and a second mounting element, wherein the first cable alignment rod and the third cable alignment rod are each attached to the bow by the first mounting element and the second cable alignment rod and the fourth cable alignment rod are each attached to the bow by the second mounting element.

* * * * *